US006761184B1

(12) United States Patent
Jordan

(10) Patent No.: US 6,761,184 B1
(45) Date of Patent: Jul. 13, 2004

(54) WATER FLUSHING UNIT FOR A PRESSURE BALANCED SHOWER VALVE

(76) Inventor: Scott C. Jordan, 8381 Idyllwild St., Ventura, CA (US) 93004

( * ) Notice: Subject to any disclaimer, the term of this patent is extended or adjusted under 35 U.S.C. 154(b) by 0 days.

(21) Appl. No.: 10/723,930

(22) Filed: Nov. 25, 2003

(51) Int. Cl.[7] ..... B08B 3/04; B08B 9/032

(52) U.S. Cl. ..... 137/238; 4/596; 4/605; 134/22.11; 134/166 C; 137/15.06; 137/15.18; 137/269; 137/270; 137/357; 137/380

(58) Field of Search ..... 4/596, 605, 662; 134/22.1, 22.11, 166 R, 166 C; 137/15.05, 15.06, 15.18, 238, 240, 269, 270, 357, 360; 239/110, 112

(56) References Cited

U.S. PATENT DOCUMENTS 3,112,073 A * 11/1963 Larson et al. ..... 239/446
4,393,891 A * 7/1983 Snoek et al. ..... 137/238
5,085,244 A * 2/1992 Funk ..... 137/240
5,141,017 A * 8/1992 Trottier ..... 137/240
5,467,796 A * 11/1995 Pettinaroli et al. ..... 137/238
5,588,459 A * 12/1996 Ellis ..... 134/166 C
6,068,023 A * 5/2000 Potter ..... 137/240
6,142,389 A * 11/2000 Kynett ..... 239/447
6,467,498 B1 * 10/2002 Esmailzadeh ..... 137/238
6,584,995 B2 * 7/2003 Kimbrough et al. ..... 137/240

* cited by examiner

*Primary Examiner*—George L. Walton
(74) *Attorney, Agent, or Firm*—Jack C. Munro

(57) ABSTRACT

A water flushing unit and a method of making such comprising a cover plate that is to be mountingly installed to replace the original equipment cover plate of a shower valve. The modified cover plate has a drain conduit which includes an on/off valve. The on/off valve is in turn connected to a flexible tube. Flushing water from the shower valve is to be confined and directed through the drain pipe and, with the on/off valve in an open position, is caused to flow through the drain tube.

8 Claims, 2 Drawing Sheets

WATER FLUSHING UNIT FOR A PRESSURE BALANCED SHOWER VALVE

BACKGROUND OF THE INVENTION

1. Field of the Invention

This invention is directed to a water flushing unit that is to be temporarily connected in conjunction with a shower valve that is to be usable to direct flushing water from the shower valve to be deposited directly in a drain opening eliminating random spraying of the flushing water from the shower valve.

2. Description of the Related Art

It is common that when a person was taking a shower, and if water was turned on at another location within the house, that the temperature of the water flowing through the shower would either drop significantly in temperature, if the water that was turned on at the other location in the house was hot water, or would rise significantly in temperature, if the water that was turned on at the other location in the house was cold water. To the individual that is taking the shower, this rapid change in temperature is uncomfortable even though the rapid change will generally be no more than a few seconds.

Within recent years, there has been constructed a pressure balanced shower valve which when installed in conjunction with the shower will cause the temperature of the water that is being emitted from the shower valve to be maintained at the selected temperature regardless of whether water is caused to flow at another location in the house. Building codes of some states require the insulation of such a shower valve. In other states and countries, shower valves can be installed optionally, although not required.

After installation of the shower valve within the house, it is necessary to flush the shower valve prior to usage. This is to eliminate any obstruction that may have gotten into the water lines of the house that may cause a clogging to occur. The typical procedure for the plumber, after installation of the shower valve, is to remove a cover plate of the shower valve. The internal chamber of the shower valve is now exposed. The plumber will then turn on the water to the house which causes the water to be expelled from the shower valve in a spraying manner. This flushing can take a matter of a few minutes and a significant amount of water could be caused to flow to an undesired location, such as within the wall of the house where normally the shower valve would be installed. This drainage of water can cause damage to drywall and flooring of the house.

It would be desirable to construct some type of device which could channel the flushing water to an appropriate water drain that is mounted in conjunction with the house eliminating the random spraying of the water from the shower valve.

SUMMARY OF THE INVENTION

A first basic embodiment of this invention comprising a water flushing unit for a pressure balanced shower valve which includes a modified cover plate that is adapted for securement onto a shower valve replacing the original equipment cover plate. A drain conduit is mounted to this modified cover plate with the drain conduit connecting with the through hole formed within the modified cover plate. An on/off valve is connected to the drain conduit. An elongated drain tube is connected to the drain conduit. Therefore, when the water flows into the shower valve, the water is to be channeled through the drain conduit and through the on/off valve, which should be in the open position, with the water flowing through the elongated drain tube.

A further embodiment of the present invention is where the first basic embodiment is modified by the modified cover plate including a series of holes each of which is adapted to connect with an appropriate bolt fastener for positive securement of the modified cover plate onto the shower valve;

A further embodiment of the present invention is where the first basic embodiment is modified by the through hole within the cover plate being centrally located within the modified cover plate;

A further embodiment of the present invention is where the first basic embodiment is modified by the drain conduit being defined as a pipe;

A further embodiment of the present invention is where the first basic embodiment is modified by the on/off valve being defined as being manually operable;

A further embodiment of the present invention is where the first basic embodiment is modified by the drain tube being defined as being flexible.

A second basic embodiment of the present invention is directed to a method of directing flow of water from a pressure balanced shower valve comprising the steps of removing a first cover plate from the shower valve, installing a second cover plate in conjunction with the shower valve in place of the first cover plate where the second cover plate has a through hole. A drain conduit is attached to the second cover plate and connects with this through hole. An on/off valve is mounted in connection with the drain conduit. A drain tube is connected to the on/off valve. Whereby when water is forced into the shower valve to flush such that the water is caused to flow through the drain conduit when the on/off valve is open and into the drain tube to be deposited in an appropriate selected ambient location.

A third basic embodiment of the present invention is directed to a method of making a water flushing unit to be used in conjunction with a pressure balanced shower valve comprising the steps of obtaining a modified cover plate that is attached onto the shower valve, replacing the original equipment cover plate of the shower valve, forming a through hole within the modified cover plate, attaching a drain pipe to the through hole so water is capable of passing from the shower valve into the drain pipe, installing an on/off valve in conjunction with drain pipe where the on/off valve is usable to control the flow of water through the drain pipe and causing a drain tube to be connected to the on/off valve which is to receive the water from the drain pipe and the on/off valve and direct such to be deposited in an appropriate selected ambient location.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
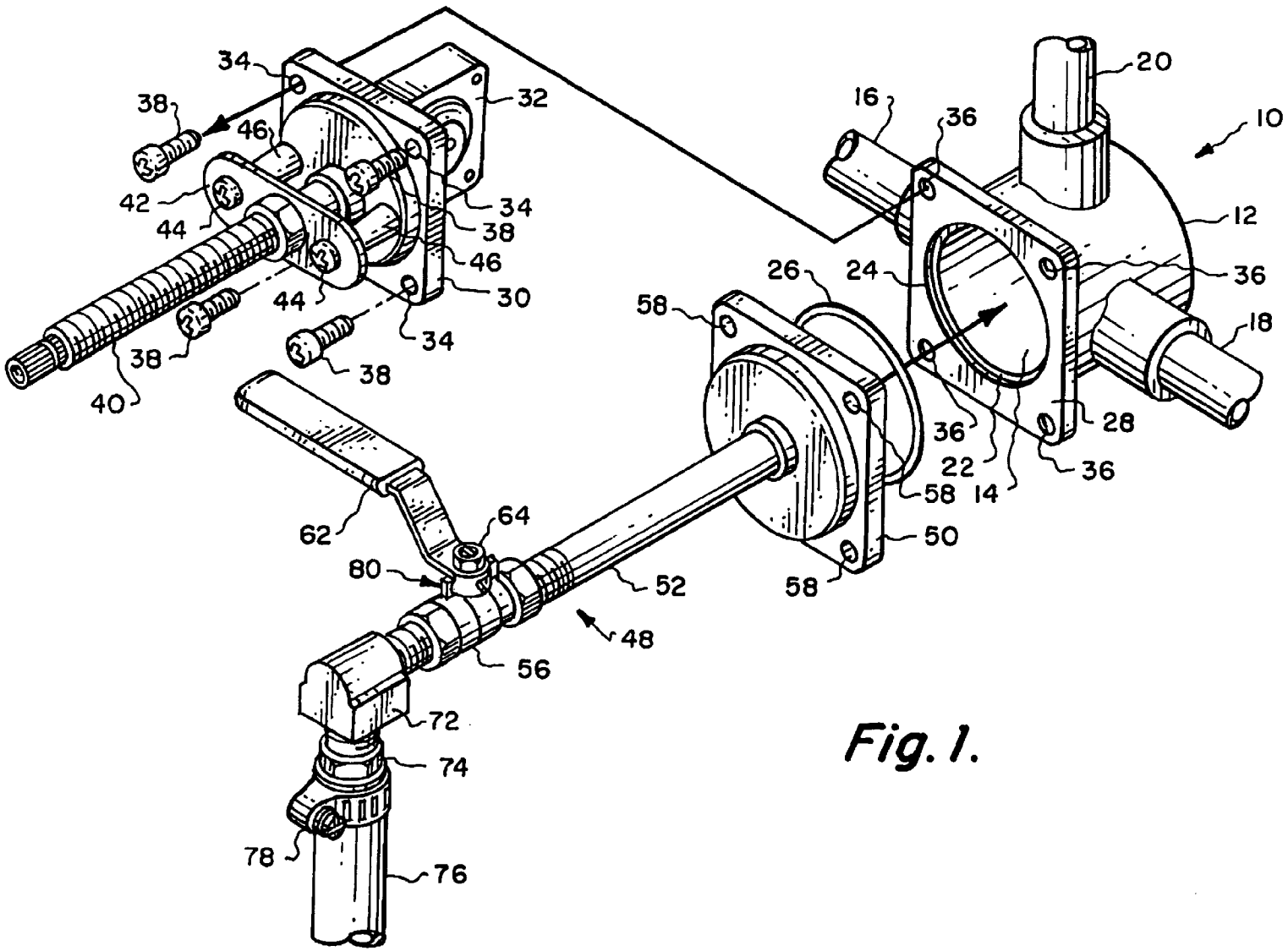
FIG. 1 is an exploded isometric view of the pressure balanced shower valve and the water flushing unit of the present invention depicting the replacement procedure that is required to install the water flushing unit of the present invention in conjunction with the shower valve body.

Referring particularly to the drawings, there is shown in FIG. 1 a pressure balanced shower valve 10. The pressure balanced shower valve 10 has a valve body 12 which has an internal chamber 14. Connecting into the valve body 12 is a cold water inlet line 16 and a hot water inlet line 18. Also connected to the valve body 12 is a water outlet line 20. The water outlet line 20 is to connect to a showerhead, which is not shown.

Access into the internal chamber 14 is provided by an access opening 22 which is located directly adjacent O-ring seat 24. There is to be an O-ring 26 that is mounted within the O-ring seat 24. The O-ring 26 will be constructed of a rubber or rubber/plastic material. Surrounding the O-ring seat 24 is a planar cover seat 28. There will normally be mounted on the cover seat 28 a cover plate 30. Mounted to the inside surface of the cover plate 30 is valving structure 32 which is to be located within the internal chamber 14. The valving structure 32 is what will control the temperature of the water that is flowing through the water outlet line 20 so as to keep that water within the water outlet line 20 essentially at a constant temperature.

The cover plate 30 is basically square in configuration and includes a hole 34 located directly adjacent each corner of the cover plate 30. The cover seat 28 is also square in configuration and also includes a hole 36 located at each corner of the cover seat 28. The cover plate 30 is to abut against the cover seat 28 and a bolt fastener 38 is to interconnect between each pair of aligned holes 34 and 36 and tightly secure the cover plate 30 to the cover seat 28. The cover plate 30 includes an outwardly extending threaded spindle 40. Lateral support for the spindle 40 is provided by bracing plate 42 which is mounted on the cover plate 30 by means of a pair of bolt fasteners 44. Each bolt fastener 44 passes through a spacer 46 with there being a pair of the spacers 46 located one-hundred and eighty degrees apart relative to the longitudinal center axis of the spindle 40. The spacers 46 extend between the cover plate 30 and the bracing plate 42.

The water flushing unit 48 of this invention utilizes a cover plate 50 which is basically similar in configuration to the cover plate 30. The exception is there is no bracing plate 42 nor any spacers 46. Instead of the spindle 40, there is mounted a conduit in the form of a drain pipe 52 through its center hole 54 formed within the cover plate 50. The outer end of the drain pipe 54 is threadingly connected to an on/off valve housing 56. The cover plate 50 is also square in configuration and has a hole 58 located directly adjacent each corner of the cover plate 50. When the cover plate 30 is removed from the cover seat 28, the cover plate 50 is replaced and mounted against the cover seat 28 with the fasteners 38 each connecting between now aligned holes 36 and 58. These fasteners 38 are then tightened until the cover plate 50 is securely mounted on the cover seat 28.

The on/off valve housing 56 has a valve spindle 60. Connected with the valve spindle 60 is a handle 62. The handle 62 is fixedly mounted to the valve spindle 60 by means of a nut 64. Turning of the handle 62 can locate the through hole 66 of the valve spindle 60 in alignment with the through passage 68 of the drain pipe 52. This through passage 68 connects to the internal chamber 14. The handle 62 can be manually moved about ninety degrees which will locate the through hole 66 at a transverse position relative to the through passage 70 formed within the on/off valve housing 56. This will result in closing of the passage 60 and will not permit any water to flow from the internal chamber 14 through the through passage 68 and through the through passage 70.

The valve housing 56 is threadingly connected to an elbow connector 72. The elbow connector 72 is in turn threadingly connected to a tube connector 74. The tube connector 74 is then securely fixed to a flexible tube 76 be means of a conventional hose clamp 78. The tube 76 can be any desired length with generally around four to five feet being preferred.

Figures 2, 3:
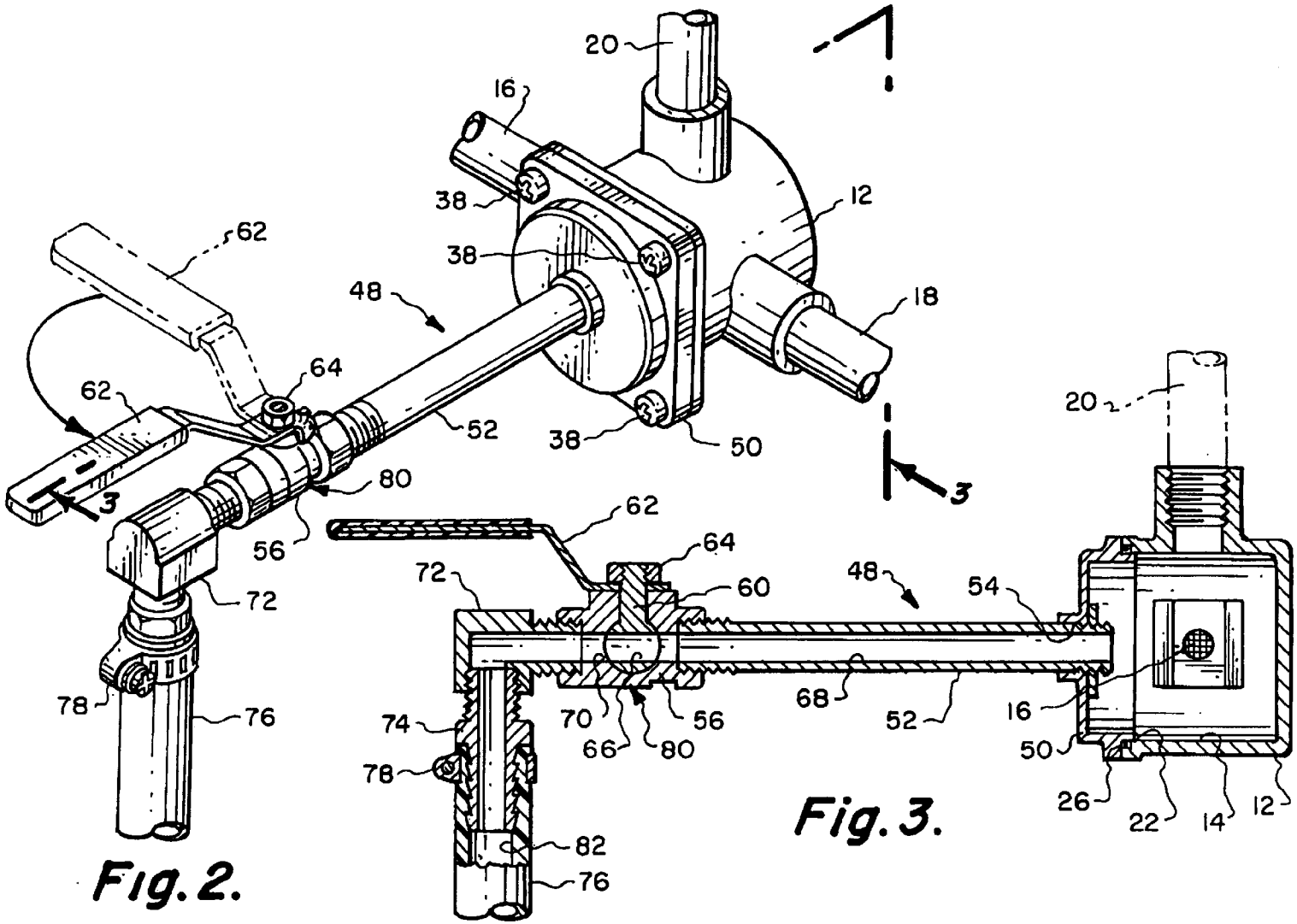
FIG. 2 is an isometric view showing the water flushing unit of the present invention installed in conjunction with the shower valve body with the water flushing unit in position for usage and depicting movement of the on/off valve of the water flushing unit between a closed position and an open position.
FIG. 3 is a longitudinal cross-sectional view through the water flushing unit of the present invention taken along line 3—3 of FIG. 2.

Let it be assumed that the valve 10 is installed in conjunction with a wall of a house. Let it also be assumed that the cold water inlet line 16 and hot water inlet line 18 are attached to the valve body 12 as is also the water outlet line 20. The plumber now wishes to flush out the water lines, and in order to accomplish this the plumber removes cover plate 30 and then installs cover plate 50 in conjunction with the cover seat 28. The plumber then positions the handle 62 in the position shown in FIG. 1 which will locate the on/off valve 80, which has the on/off valve housing 56, in the closed position not permitting the flow of any water from the internal chamber 14 to within the through passage 82 of the tube 76. The plumber then proceeds to turn on the water to the house which will cause water to flow within the internal chamber 14 under generally forty to eighty pounds per square inch pressure. The plumber then will locate the free end of the tube 76, which is not shown, in a water drain, which is not shown, and then turn the handle 62 to the position shown in FIG. 3 which will align passage 70 with passage 68. Water will then flow through into the through passage 82 of the tube 76 thereby flushing out the water lines 16, 18 and internal chamber 14. Generally, this flushing procedure will proceed for a few minutes at which time the plumber will then turn off the water to the residence, remove the cover plate 50 from the cover seat 28 and reinstall the cover plate 30 back in position with the cover plate 38.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be added for the device described, but also a method claims are added to address the method of making and using the invention. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A water flushing unit for a pressure balanced shower valve comprising:

a cover plate adapted for securement onto a shower valve, said cover plate having a through hole;

a drain conduit mounted to said cover plate, said drain conduit connecting with said through hole;

an on/off valve connected to said drain conduit; and an elongated drain tube connected to said drain conduit, whereby when water flows into the shower valve the water is directed through said drain conduit, and if said on/off valve is open, the water will flow through said elongated drain tube to be deposited at an appropriate ambient location.

2. The water flushing unit as defined in claim 1 wherein:

said cover plate having a series of fastening holes each of which is to be utilized in conjunction with a bolt fastener that is to be secured to the shower valve.

3. The water flushing unit as defined in claim 1 wherein:

said through hole being centrally formed within said cover plate.

4. The water flushing unit as defined in claim 1 wherein:

said drain conduit comprising a pipe.

5. The water flushing unit as defined in claim 1 wherein:

said on/off valve being manually operable.

6. The water flushing unit as defined in claim 1 wherein:

said drain tube being flexible so as to be readily bendable to permit said drain tube to connect with a selected ambient location to confiningly direct the water that is conducted from the drain tube into that location.

7. A method of directing flow of water from a pressurized balanced shower valve comprising the steps of:

removing a first cover plate from the shower valve;

installing a second cover plate on the shower valve in place of the first cover plate where the second cover plate has a through hole;

having a drain conduit attached to the second cover plate and connecting with the through hole;

having an on/off valve mounted to the drain conduit;

having a drain tube connected to the on/off valve; and whereby when water is forced into the shower valve to flush such, the water is caused to flow through said drain conduit when said on/off valve is opened and then into the drain tube to be deposited at an appropriate selected ambient location.

8. A method of assembling a water flushing unit to be used in conjunction with a pressure balanced shower valve comprising the steps of:

obtaining a modified cover plate that is attachable onto the shower valve replacing an original equipment cover plate of the shower valve;

providing a through hole within the modified cover plate;

attaching a drain pipe to the through hole so water is capable of passing from the shower valve into the drain pipe;

installing an on/off valve in conjunction with the drain pipe where the on/off valve is usable to control the flow of water through the drain pipe; and connecting a drain tube to the on/off valve which is to remove water from the drain pipe and the on/off valve and direct such to be deposited in an appropriate selected ambient location.

* * * * *